US010401784B2

(12) United States Patent
Itabashi

(10) Patent No.: US 10,401,784 B2
(45) Date of Patent: Sep. 3, 2019

(54) IMAGE FORMING APPARATUS HAVING ROTATABLY MOUNTED DRUM CARTRIDGE

(71) Applicant: Brother Kogyo Kabushiki Kaisha, Nagoya-shi, Aichi-ken (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/136,882

(22) Filed: Sep. 20, 2018

(65) Prior Publication Data

US 2019/0155190 A1 May 23, 2019

(30) Foreign Application Priority Data

Nov. 17, 2017 (JP) ..... 2017-221800
Aug. 29, 2018 (JP) ..... 2018-160301

(51) Int. Cl.
*G03G 21/00* (2006.01)
*G03G 21/18* (2006.01)

(52) U.S. Cl.
CPC ..... *G03G 21/1821* (2013.01); *G03G 21/1825* (2013.01); *G03G 2221/1861* (2013.01); *G03G 2221/1869* (2013.01)

(58) Field of Classification Search
CPC ..... G03G 21/1821; G03G 21/1825; G03G 21/1842; G03G 21/1846; G03G 21/1853; G03G 2221/1846; G03G 2221/1861; G03G 2221/1869
USPC ..... 399/111, 113
See application file for complete search history.

(56) References Cited

U.S. PATENT DOCUMENTS 8,594,530 B2 11/2013 Sato et al.
8,737,870 B2 * 5/2014 Mori ..... G03G 21/1853 399/110
9,529,318 B2 * 12/2016 Sato ..... G03G 21/1661
2009/0190953 A1 * 7/2009 Okabe ..... G03G 21/1853 399/111
2012/0183320 A1 7/2012 Sato et al.
2015/0362888 A1 12/2015 Itabashi
2017/0060081 A1 * 3/2017 Kikuchi ..... G03G 21/1647

FOREIGN PATENT DOCUMENTS

JP 2012-144019 A 8/2012
JP 2016-004113 A 1/2016

* cited by examiner

*Primary Examiner* — Robert B Beatty
(74) *Attorney, Agent, or Firm* — Banner & Witcoff, Ltd.

(57) ABSTRACT

A drawer unit moves in a moving direction between an internal position inside a main housing and an external position outside the main housing. The drawer unit includes: a drawer frame configured such that a drum cartridge and a developing cartridge are mounted thereon; and an exposure head that exposes a photosensitive drum. In a state where the drawer frame is located at the external position and where the drum cartridge is mounted on the drawer frame, the drum cartridge rotatably moves between: a first position at which the exposure head is located at a particular position relative to the photosensitive drum and the drum cartridge is prevented from being removed from the drawer frame; and a second position at which the exposure head is deviated from the particular position relative to the photosensitive drum and the drum cartridge is allowed to be removed from the drawer frame.

11 Claims, 11 Drawing Sheets

IMAGE FORMING APPARATUS HAVING ROTATABLY MOUNTED DRUM CARTRIDGE

CROSS REFERENCE TO RELATED APPLICATIONS

This application claims priority from Japanese Patent Application Nos. 2017-221800 filed Nov. 17, 2017 and 2018-160301 filed Aug. 29, 2018. The entire content of each of the priority applications is incorporated herein by reference.

TECHNICAL FIELD

This disclosure relates to an image forming apparatus.

BACKGROUND

Conventionally, there is known an image forming apparatus that includes a drum cartridge, a developing cartridge, and a drawer unit. The drum cartridge includes a photosensitive drum. The developing cartridge accommodates toner that is supplied to the photosensitive drum. The drawer unit includes an exposure head for exposing the photosensitive drum.

SUMMARY

According to one aspect, this specification discloses an image forming apparatus. The image forming apparatus includes a main housing, a drum cartridge, a developing cartridge, and a drawer unit. The drum cartridge includes a photosensitive drum. The developing cartridge is configured to accommodate developer to be supplied to the photosensitive drum. The drawer unit is configured such that the drum cartridge and the developing cartridge are mounted thereon. The drawer unit is configured to move in a moving direction between an internal position at which the drawer unit is located inside the main housing and an external position at which the drawer unit is located outside the main housing. The drawer unit includes: a drawer frame configured such that the drum cartridge and the developing cartridge are mounted thereon; and an exposure head configured to expose the photosensitive drum. In a state where the drawer frame is located at the external position and where the drum cartridge is mounted on the drawer frame, the drum cartridge is configured to rotatably move between: a first position at which the exposure head is located at a particular position relative to the photosensitive drum and the drum cartridge is prevented from being removed from the drawer frame; and a second position at which the exposure head is deviated from the particular position relative to the photosensitive drum and the drum cartridge is allowed to be removed from the drawer frame.

BRIEF DESCRIPTION OF THE DRAWINGS

Embodiments in accordance with this disclosure will be described in detail with reference to the following figures wherein.

DETAILED DESCRIPTION

When the drum cartridge is to be mounted onto the drawer unit that includes the exposure head as described above, the drum cartridge needs to be mounted or removed while avoiding the exposure head.

An example of an object of this disclosure is to provide an image forming apparatus with which it is possible to mount/remove a drum cartridge onto/from a drawer unit that includes an exposure head while avoiding the exposure head.

1. Image Forming Apparatus

An image forming apparatus is described with reference to FIGS. 1 and 2.

Figure 1:
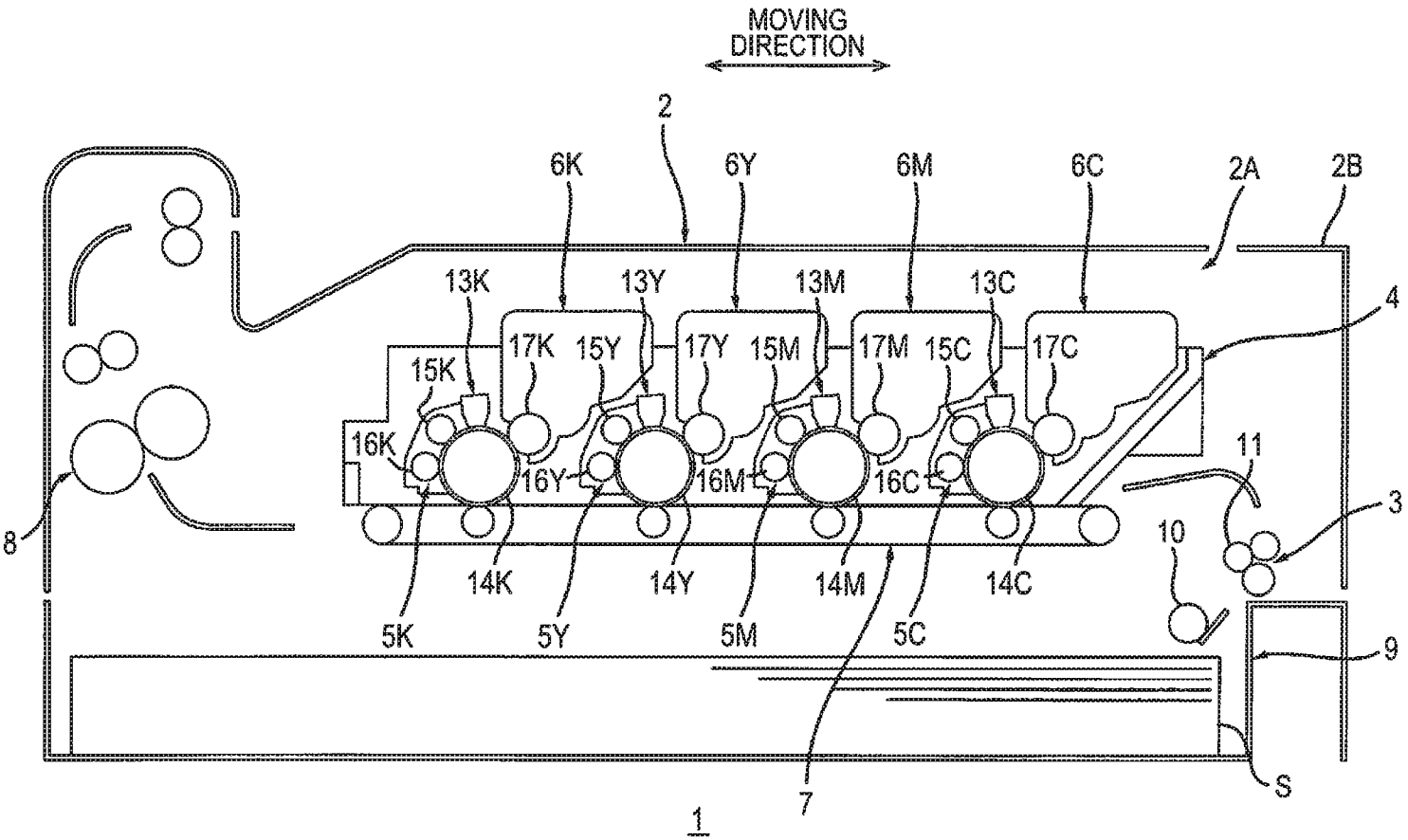
FIG. 1 is a schematic diagram of an image forming apparatus.

As shown in FIG. 1, an image forming apparatus 1 includes a main housing 2, a feeder 3, a drawer unit 4, a plurality of drum cartridges 5K, 5Y, 5M, 5C, a plurality of developing cartridges 6K, 6Y, 6M, 6C, a transfer unit 7, and a fixing device 8.

1.1 Main Housing

The main housing 2 forms an exterior of the image forming apparatus 1. The main housing 2 accommodates the feeder 3, the drawer unit 4, the plurality of drum cartridges 5K, 5Y, 5M, 5C, the plurality of developing cartridges 6K, 6Y, 6M, 6C, the transfer unit 7 and the fixing device 8. The main housing 2 has an opening 2A. The opening 2A is located at an opposite side from the drawer unit 4 with respect to the fixing device 8 in a state where the drawer unit 4 is in an internal position. The internal position is described later. In addition, the main housing 2 includes a cover 2B. The cover 2B is configured to move between a closed position (see FIG. 1) at which the opening 2A is closed and an open position (see FIG. 2) at which the opening 2A is open.

1.2 Feeder

The feeder 3 is configured to supply a sheet S to a photosensitive drum 14C. The sheet S is, for example, printing paper. The photosensitive drum 14C is described later. The feeder 3 includes a sheet feed tray 9, a pick-up roller 10 and a sheet feed roller 11. The sheet feed tray 9 accommodates the sheet S. The pick-up roller 10 is configured to convey the sheet S that is inside the sheet feed tray 9 to the sheet feed roller 11. The sheet feed roller 11 is configured to convey the sheet S from the pick-up roller 10 to the photosensitive drum 14C.

1.3 Drawer Unit

Figure 2:
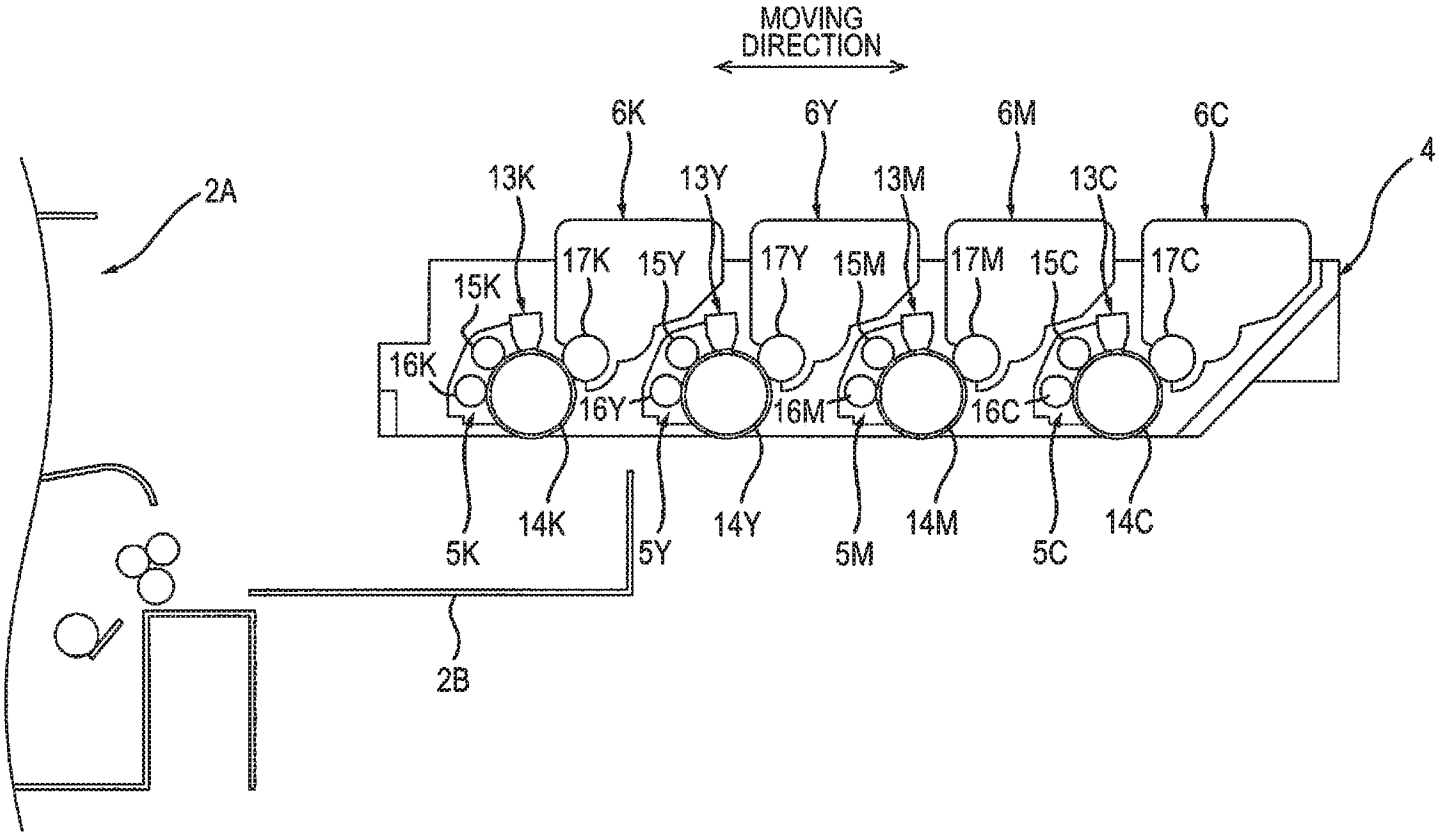
FIG. 2 is an illustration of a state in which a drawer unit illustrated in FIG. 1 is in an external position.

As shown in FIG. 2, the drawer unit 4 moves between an internal position (see FIG. 1) and an external position (see FIG. 2) through the opening 2A when the cover 2B is at the open position. The internal position is a position of the drawer unit 4 when the drawer unit 4 is located inside the main housing 2. The external positon is a position of the drawer unit 4 when the drawer unit 4 is located outside of the main housing 2. A direction in which the drawer unit 4 moves between the internal position and the external position is defined as a moving direction. As shown in FIG. 1, the drawer unit 4 includes a plurality of exposure heads 13K, 13Y, 13M, 13C.

The plurality of exposure heads 13K, 13Y, 13M, 13C forms a row along the moving direction with intervals between the exposure heads. The plurality of exposure heads 13K, 13Y, 13M, 13C is located above the plurality of photosensitive drums 14K, 14Y, 14M, 14C in a state where the plurality of drum cartridges 5K, 5Y, 5M, 5C is mounted on the drawer unit 4. The exposure head 13K is configured to expose the photosensitive drum 14K. The exposure head 13Y is configured to expose the photosensitive drum 14Y. The exposure head 13M is configured to expose the photosensitive drum 14M. The exposure head 13C is configured to expose the photosensitive drum 14C.

1.4 Plurality of Drum Cartridges

Each of the plurality of drum cartridges 5K, 5Y, 5M, 5C is configured to be mounted onto the drawer unit 4 when the drawer unit 4 is at the external position (see FIG. 2). In a state where the plurality of drum cartridges 5K, 5Y, 5M, 5C is mounted on the drawer unit 4, the plurality of drum cartridges 5K, 5Y, 5M, 5C forms a row along the mounting direction with intervals between the drum cartridges.

The drum cartridge 5K includes a photosensitive drum 14K, a charger 15K, and a cleaning member 16K.

The photosensitive drum 14K rotates about a rotational axis that extends in a width direction (see FIG. 5) of the drawer unit 4 in a state where the drum cartridge 5K is mounted on the drawer unit 4. The width direction of the drawer unit 4 is described later. The photosensitive drum 14K extends along the rotational axis. The photosensitive drum 14K has a cylindrical shape.

The charger 15K is configured to charge the surface of the photosensitive drum 14K. The charger 15K charges the surface of the photosensitive drum 14K. Then, the exposure head 13K exposes the surface of the charged photosensitive drum 14K, to thereby form an electrostatic latent image on the surface of the photosensitive drum 14K. The charger 15K is located at an opposite side from a developing roller 17K with respect to the exposure head 13K in the moving direction in a state where the drum cartridge 5K is mounted on the drawer unit 4. The developing roller 17K is described later. The charger 15K is located at an upstream side of the exposure head 13K in a direction of rotation of the photosensitive drum 14K in a state where the drum cartridge 5K is mounted on the drawer unit 4. More specifically, the charger 15K is a charging roller. Note that the charger 15K may be a scorotron charger. The width of the charger 15K is larger than or equal to one third (⅓) and smaller than or equal to half (½) the diameter of the photosensitive drum 14K. More specifically, when the charger 15K is a charging roller, the charger 15K has a diameter of 9 mm and the photosensitive drum 14K has a diameter of 24 mm. Alternatively, when the charger 15K has a diameter of 11 mm, the photosensitive drum 14K has a diameter of 28 mm. Further, when the charger 15K has a diameter of 7 mm, the photosensitive drum 14K has a diameter of 20 mm. In other words, the diameter of the charger 15K is larger than or equal to one third and smaller than or equal to half the diameter of the photosensitive drum 14K. Because of this, the charger 15K can easily be prevented from interfering with the exposure head 13K when the drum cartridge 5K is mounted onto or removed from the drawer unit 4. In particular, in a state where the drum cartridge 5K and the developing cartridge 6K are mounted on the drawer unit 4 and where the drawer unit 4 is mounted on the main housing 2, the exposure head 13K is located above the photosensitive drum 14K, the transfer unit 7 is located below the photosensitive drum 14K, and the charger 15K is located at an opposite side from the developing roller 17K with respect to the exposure head 13K in the moving direction. With this configuration, the charger 15K can easily be prevented from interfering with the exposure head 13K when the drum cartridge 5K is mounted onto or removed from the drawer unit 4 on the same side as the developing cartridge 6K with respect to the exposure head 13K.

The cleaning member 16K is configured to clean the surface of the photosensitive drum 14K. The cleaning member 16K is located at an upstream side of the charger 15K in the direction of rotation of the photosensitive drum 14K in a state where the drum cartridge 5K is mounted on the drawer unit 4. Note that in a configuration where the drum cartridge 5K includes the cleaning member 16K, the arrangement of the charger 15K is further restricted and it becomes difficult to prevent interference between the charger 15K and the exposure head 13K. However, as described above, if the charger 15K has a diameter that is larger than or equal to one third and smaller than or equal to half the diameter of the photosensitive drum 14K, the charger 15K can easily be prevented from interfering with the exposure head 13K when the drum cartridge 5K is mounted onto or removed from the drawer unit 4.

More specifically, the cleaning member 16K is a cleaning roller. The cleaning member 16K contacts the surface of the photosensitive drum 14K. The cleaning member 16K has a diameter of 9 mm and the photosensitive drum 14K has a diameter of 24 mm. Alternatively, when the cleaning member 16K has a diameter of 11 mm, the photosensitive drum 14K has a diameter of 28 mm. Further, when the cleaning member 16K has a diameter of 7 mm, the photosensitive drum 14K has a diameter of 20 mm. In other words, the cleaning member 16K has a diameter that is larger than or equal to one third and smaller than or equal to half the diameter of the photosensitive drum 14K. Note that the cleaning member 16K may be a cleaning blade.

Note that the drum cartridge 5Y includes the photosensitive drum 14Y, a charger 15Y, and a cleaning member 16Y. The drum cartridge 5M includes the photosensitive drum 14M, a charger 15M, and a cleaning member 16M. The drum cartridge 5C includes the photosensitive drum 14C, a charger 15C, and a cleaning member 16C. The drum cartridges 5Y, 5M, 5C all have the same structure as the drum cartridge 5K and are described in the same way as the drum cartridge 5K. Therefore, a description of the drum cartridges 5Y, 5M, 5C is omitted.

1.5 Plurality of Developing Cartridges

The plurality of developing cartridges 6K, 6Y, 6M, 6C is configured to be mounted onto the drawer unit 4 when the drawer unit 4 is at the external position (see FIG. 2). When mounted onto the drawer unit 4, the plurality of developing cartridges 6K, 6Y, 6M, 6C forms a row in the moving direction with intervals between the developing cartridges.

The developing cartridge 6K is configured to store toner that is supplied to the photosensitive drum 14K. The developing cartridge 6K includes the developing roller 17K.

The developing roller 17K is configured to supply toner stored in the developing cartridge 6K to the photosensitive drum 14K. An electrostatic latent image is developed by supplying the toner stored in the developing cartridge 6K to the photosensitive drum 14K on which the electrostatic latent image has been formed. With this, a toner image is formed on the surface of the photosensitive drum 14K. In other words, the toner image is formed on the surface of the photosensitive drum 14K by electrostatically moving the toner from the developing roller 17K to the photosensitive drum 14K and developing the electrostatic latent image that is formed on the photosensitive drum 14K. A part of the developing roller 17K is accommodated in the developing cartridge 6K. The developing roller 17K is located at a downstream side of the exposure head 13K in the direction of rotation of the photosensitive drum 14K in a state where the drum cartridge 5K and the developing cartridge 6K are mounted on the drawer unit 4. The developing roller 17K contacts the surface of the photosensitive drum 14K in a state where the drum cartridge 5K and the developing cartridge 6K are mounted on the drawer unit 4.

Note that the developing cartridge 6Y is configured to store the toner that is supplied to the photosensitive drum 14Y and includes the developing roller 17Y. The developing cartridge 6M is configured to store the toner that is supplied to the photosensitive drum 14M and includes the developing roller 17M. The developing cartridge 6C is configured to store the toner that is supplied to the photosensitive drum 14C and includes the developing roller 17C. The developing cartridges 6Y, 6M, 6C all have the same structure as the developing cartridge 6K and are described in the same way as the developing cartridge 6K. Therefore, a description of the developing cartridges 6Y, 6M, 6C is omitted.

1.6 Transfer Unit

The transfer unit 7 is located below the plurality of photosensitive drums 14K, 14Y, 14M, 14C in a state where the plurality of drum cartridges 5K, 5Y, 5M, 5C is mounted on the drawer unit 4 and the drawer unit 4 is at the internal position. The transfer unit 7 contacts the plurality of photosensitive drums 14K, 14Y, 14M, 14C in a state where the plurality of drum cartridges 5K, 5Y, 5M, 5C is mounted on the drawer unit 4 and the drawer unit 4 is at the internal position. The transfer unit 7 conveys the sheet S that is supplied from the feeder 3 to the fixing device 8. The transfer unit 7 transfers toner images of each of the plurality of photosensitive drums 14K, 14Y, 14M, 14C onto the sheet S when the sheet S contacts each of the plurality of photosensitive drums 14K, 14Y, 14M, 14C.

1.7 Fixing Device

The fixing device 8 is configured to heat and apply pressure to the sheet S on which the toner image has been transferred to affix the toner image to the sheet S. The sheet S passes through the fixing device 8 and is discharged to a top surface of the main housing 2.

2. Details of Drum Cartridge

The drum cartridge 5K is described below with reference to FIGS. 3 and 4.

Figure 3:
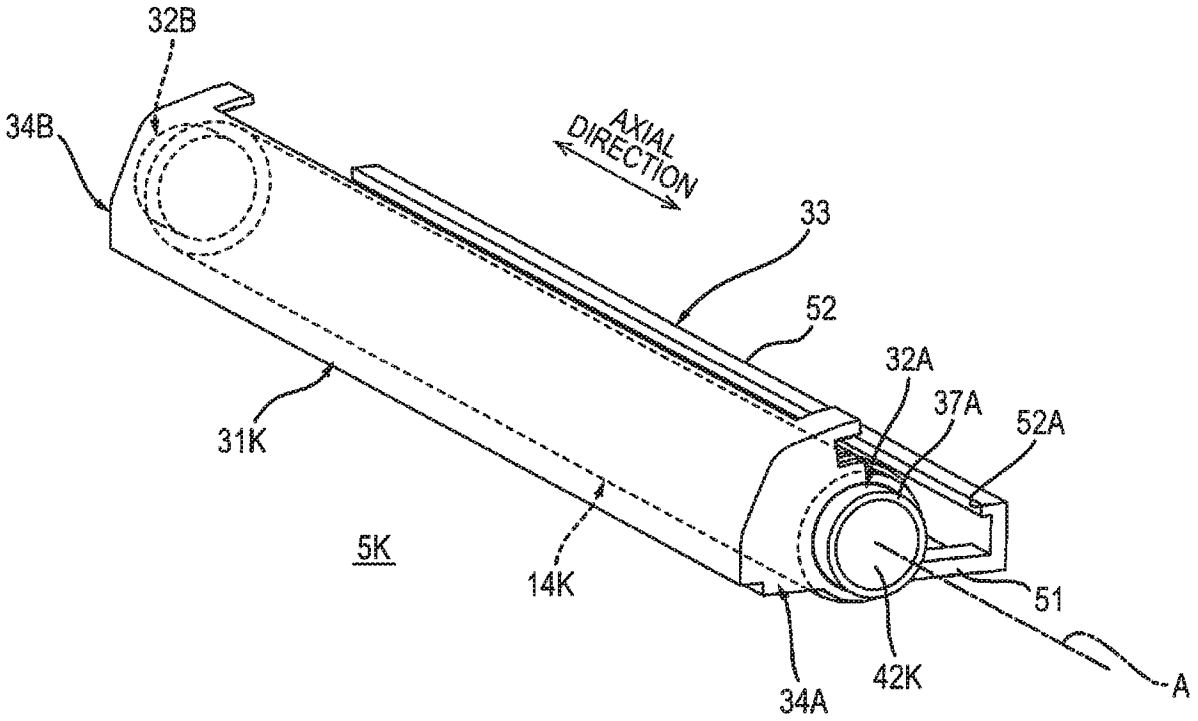
FIG. 3 is a schematic view of a drum cartridge illustrated in FIG. 1.

As shown in FIG. 3, the drum cartridge 5K includes a drum frame 31K, flange receiving members 32A, 32B, and a handle 33 in addition to the above-described photosensitive drum 14K, charger 15K (see FIG. 1) and cleaning member 16K (see FIG. 1).

2.1 Drum Frame

The drum frame 31K supports the photosensitive drum 14K, the charger 15K and the cleaning member 16K. The drum frame 31K covers the photosensitive drum 14K, the charger 15K and the cleaning member 16K. The drum frame 31K extends in an axial direction. The axial direction is a direction in which the rotational axis of the photosensitive drum 14K extends. The drum frame 31K includes a first side wall 34A and a second side wall 34B. In other words, the drum cartridge 5K includes the first side wall 34A and the second side wall 34B.

Figure 4:
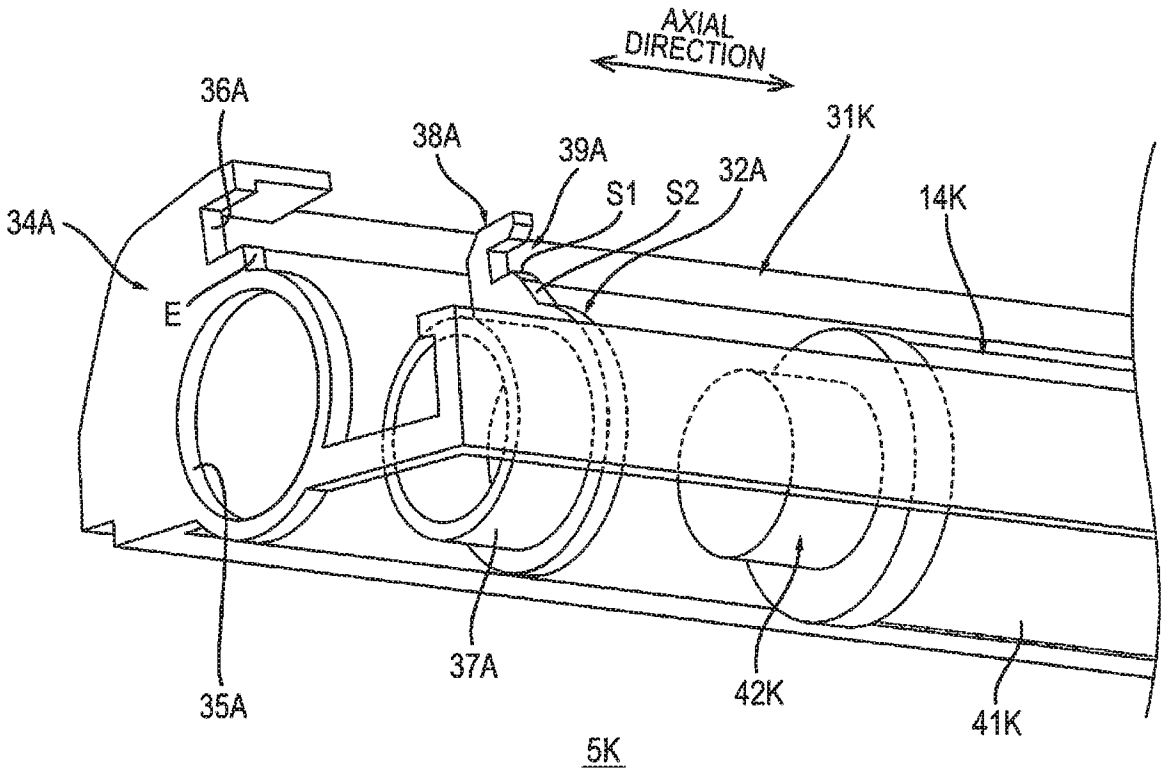
FIG. 4 is an explanatory view for explaining a flange receiving member of the drum cartridge illustrated in FIG. 3.

As shown in FIG. 4, the first side wall 34A is located at one end of the drum frame 31K in the axial direction. The first side wall 34A includes a through hole 35A. A cylindrical portion 37A of the flange receiving member 32A is fitted into the through hole 35A. The cylindrical portion 37A is described later. The first side wall 34A also includes a groove 36A (recess or cutout). The groove 36A overlaps a groove 39A (recess or cutout) of the flange receiving member 32A in the axial direction in a state where the flange receiving member 32A is attached to the drum frame 31K.

The second side wall 34B (see FIG. 3) is located at another end of the drum frame 31K in the axial direction. Note that the second side wall 34B has the same structure as the first side wall 34A and is described in the same way as the first side wall 34A. Therefore, a description of the second side wall 34B is omitted.

2.2 Flange Receiving Member

The flange receiving member 32A receives a flange of the photosensitive drum 14K. More specifically, the photosensitive drum 14K includes a drum body 41K, a first flange 42K, and a second flange. The second flange is not shown in the drawings. The drum body 41K extends in the axial direction. The drum body 41K has a cylindrical shape. The first flange 42K is attached to one end of the drum body 41K in the axial direction. In other words, an end portion of the photosensitive drum 14K has a flange. The second flange is attached to another end of the drum body 41K in the axial direction. The flange receiving member 32A receives the first flange 42K of the photosensitive drum 14K. The flange receiving member 32A includes the cylindrical portion 37A and a protrusion 38A.

The cylindrical portion 37A extends in the axial direction. The first flange 42K of the photosensitive drum 14K is fitted into the cylindrical portion 37A, and the cylindrical portion 37A is fitted into the through hole 35A of the drum frame 31K. With this configuration, the flange receiving member 32A is attached to the drum frame 31K. In a state where the flange receiving member 32A is attached to the drum frame 31K, the cylindrical portion 37A protrudes out from the first side wall 34A of the drum frame 31K through the through hole 35A. The portion of the cylindrical portion 37A that protrudes out from the first side wall 34A is fitted into a drum guide 62K (see FIG. 6). The drum guide 62K is described later.

The protrusion 38A extends from a peripheral surface of the cylindrical portion 37A. The protrusion 38A extends in a radial direction of the cylindrical portion 37A. The protrusion 38A is located between the first side wall 34A and the second side wall 34B (see FIG. 3) in the axial direction in a state where the flange receiving member 32A is attached to the drum frame 31K. The protrusion 38A is located between the first side wall 34A and the drum body 41K in the axial direction in a state where the flange receiving member 32A is attached to the drum frame 31K. The protrusion 38A includes the groove 39A. The protrusion 38A has a contact surface S1 and a guide surface S2. In other words, the flange receiving member 32A has the contact surface S1 and the guide surface S2. Further, in other words, the drum cartridge 5K has the contact surface S1 and the guide surface S2. By providing the flange receiving member 32A with the contact surface S1, precision of positioning the exposure head 13K on the photosensitive drum 14K can be improved.

Figure 8:
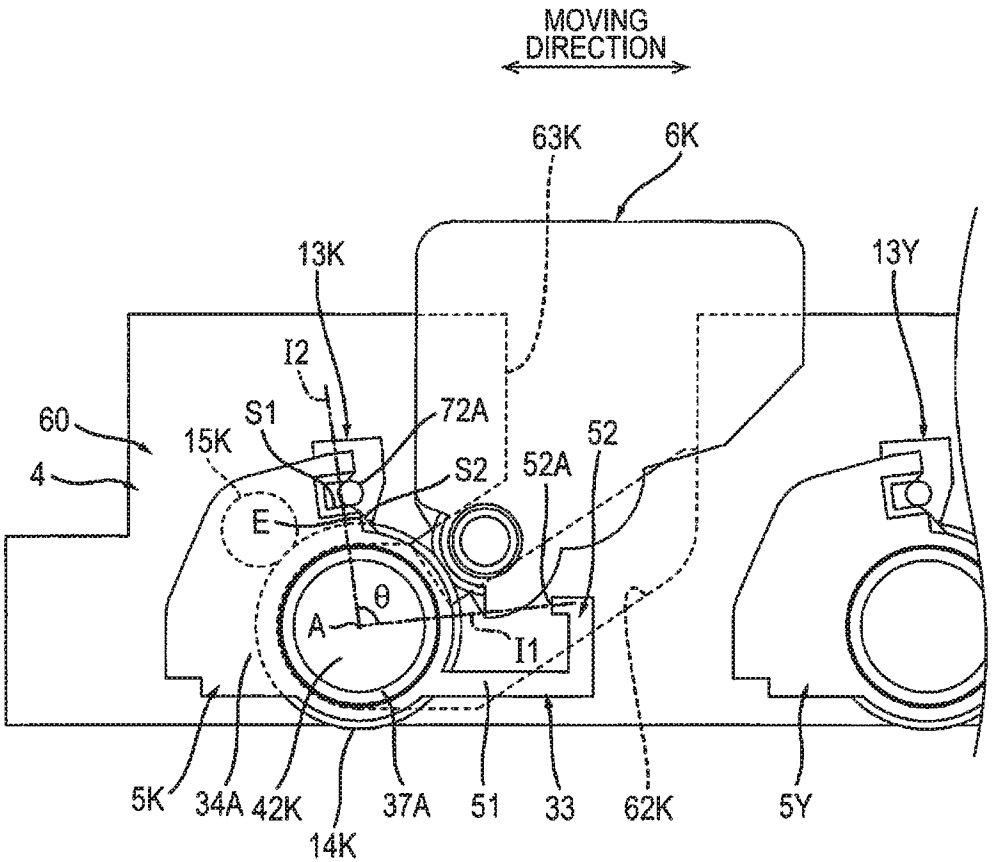
FIG. 8 is an explanatory view for explaining removal of the drum cartridge from the drawer unit and illustrates a state in which the drum cartridge and a developing cartridge are mounted onto the drawer unit.

The contact surface S1 located at a position that is different from the position at which the first flange 42K is received. More specifically, the contact surface S1 is located at a position of the flange receiving member 32A that is different from the cylindrical portion 37A that receives the first flange 42K. In other words, the cylindrical portion 37A that receives the first flange 42K and the contact surface S1 are formed at different positions in the flange receiving member 32A. The contact surface S1 is an inner surface of the groove 39A. The contact surface S1 is located between the first side wall 34A and the second side wall 34B (see FIG. 3) in the axial direction in a state where the flange receiving member 32A is attached to the drum frame 31K. The contact surface S1 is located between the first side wall 34A and the drum body 41K in the axial direction in a state where the flange receiving member 32A is attached to the drum frame 31K. As shown in FIG. 8, the contact surface S1 contacts a boss 72A of the exposure head 13K in a state where the drum cartridge 5K is mounted on the drawer unit 4. With this configuration, the boss 72A positions the exposure head 13K relative to the photosensitive drum 14K. By providing the flange receiving member 32A with the cylindrical portion 37A that receives the first flange 42K and the contact surface S1 that contacts the boss 72A, errors do not accumulate in each member and an error in the distance between the exposure head 13K and the photosensitive drum 14K can be reduced, compared to a configuration that the cylindrical portion 37A that receives the first flange 42K and the contact surface S1 that contacts the boss 72A are provided as separate members.

Here, "position the exposure head 13K relative to the photosensitive drum 14K" means that the exposure head 13K does not move relative to the photosensitive drum 14K under a state where the distance between the exposure head 13K and the photosensitive drum 14K is kept constant due to contact between the boss 72A and the contact surface S1. In other words, "position the exposure head 13K relative to the photosensitive drum 14K" does not mean fixing or bonding the exposure head 13K and the photosensitive drum 14K by a screw or by an adhesive, for example, such that the exposure head 13K and the photosensitive drum 14K do not move relative to each other.

The guide surface S2 guides the boss 72A to the contact surface S1 when the drum cartridge 5K is mounted onto the drawer unit 4. The guide surface S2 is located at an opposite side from the charger 15K with respect to the contact surface S1 in the moving direction. The guide surface S2 is located at a downstream side of the contact surface S1 in the direction of rotational movement of the drum cartridge 5K when the drum cartridge 5K is mounted onto the drawer unit 4. The guide surface S2 is continuous with the contact surface S1. Note that the guide surface S2 is located farther downstream than an edge E of the first side wall 34A in the direction of rotation of the drum cartridge 5K when the drum cartridge 5K is to be mounted onto the drawer unit 4. With this configuration, the boss 72A does not contact the first side wall 34A when the guide surface S2 guides the boss 72A. The guide surface S2 is configured to guide the boss 72A to the contact surface S1 without allowing the boss 72A to contact the edge E of the first side wall 34A in accordance with the rotational movement of the drum cartridge 5K when the drum cartridge 5K is mounted onto the drawer unit 4. Similarly, a boss 72B (see FIG. 5) does not contact the second side wall 34B when the guide surface S2 of the flange receiving member 32B (see FIG. 3) guides the boss 72B. As shown in FIG. 4, the guide surface S2 is located between the first side wall 34A and the second side wall 34B (see FIG. 3) in the axial direction.

2.3 Handle

The handle 33 shown in FIG. 3 is grasped by a user when the user mounts the drum cartridge 5Y onto the drawer unit 4. The handle 33 is provided on the drum frame 31K. The handle 33 has a first arm 51, a second arm, and a grip 52.

The first arm 51 extends from the first side wall 34A of the drum frame 31K. The first arm 51 is connected to one end of the grip 52 in the axial direction.

The second arm extends from the second side wall 34B of the drum frame 31K. The second arm is connected to another end of the grip 52 in the axial direction.

The grip 52 extends in an upper-lower direction and in the axial direction in a state where the drum cartridge 5K is mounted on a drawer frame 60. The grip 52 is located away from the photosensitive drum 14K in the radial direction of the photosensitive drum 14K. The grip 52 includes a rib 52A. The rib 52A is located at an upper end of the grip 52 in a state where the drum cartridge 5K is mounted on the drawer frame 60. The rib 52A protrudes from the grip 52 toward the photosensitive drum 14K. The rib 52A extends in the axial direction.

As shown in FIG. 8, the handle 33 is located below the developing cartridge 6K in a state where the drum cartridge 5K and the developing cartridge 6K are mounted on the drawer frame 60 and where the drum cartridge 5K is at a first position. With this configuration, when viewed from above, the handle 33 is hidden behind the developing cartridge 6K in a state where the drum cartridge 5K and the developing cartridge 6K are mounted on the drawer frame 60 and where the drum cartridge 5K is at the first position. Because of this, the user easily understands that the developing cartridge 6K is to be removed before the drum cartridge 5K is removed. Note that the first position is described later. The handle 33 is located between the drum cartridge 5K and the drum cartridge 5Y in a state where the drum cartridge 5K and the drum cartridge 5Y are mounted on the drawer frame 60 and where the drum cartridge 5K is at the first position.

An angle θ formed by a first imaginary plane I1 that passes through an rotational axis A of the photosensitive drum 14K and intersects the handle 33 and a second imaginary plane I2 that passes through the rotational axis A of the photosensitive drum 14K and intersects the contact surface S1 is larger than or equal to 90 degrees and smaller than 160 degrees. More specifically, the first imaginary plane I1 passes through the rotational axis A of the photosensitive drum 14K and intersects the rib 52A. The second imaginary plane I2 passes through the rotational axis A of the photosensitive drum 14K and is perpendicular to the contact surface S1. When the angle θ is smaller than the above-given upper limit, members such as the charger 15K and the cleaning member 16K can be arranged so as to face the photosensitive drum 14K between the transfer unit 7 and the exposure head 13K on the surface of the photosensitive drum 14K. When the angle θ is larger than or equal to the above-given lower limit, the developing cartridge 6K can be arranged freely and mounted or removed freely.

3. Details of Drawer Unit

The drawer unit 4 is described below with reference to FIGS. 5 to 7.

Figure 5:
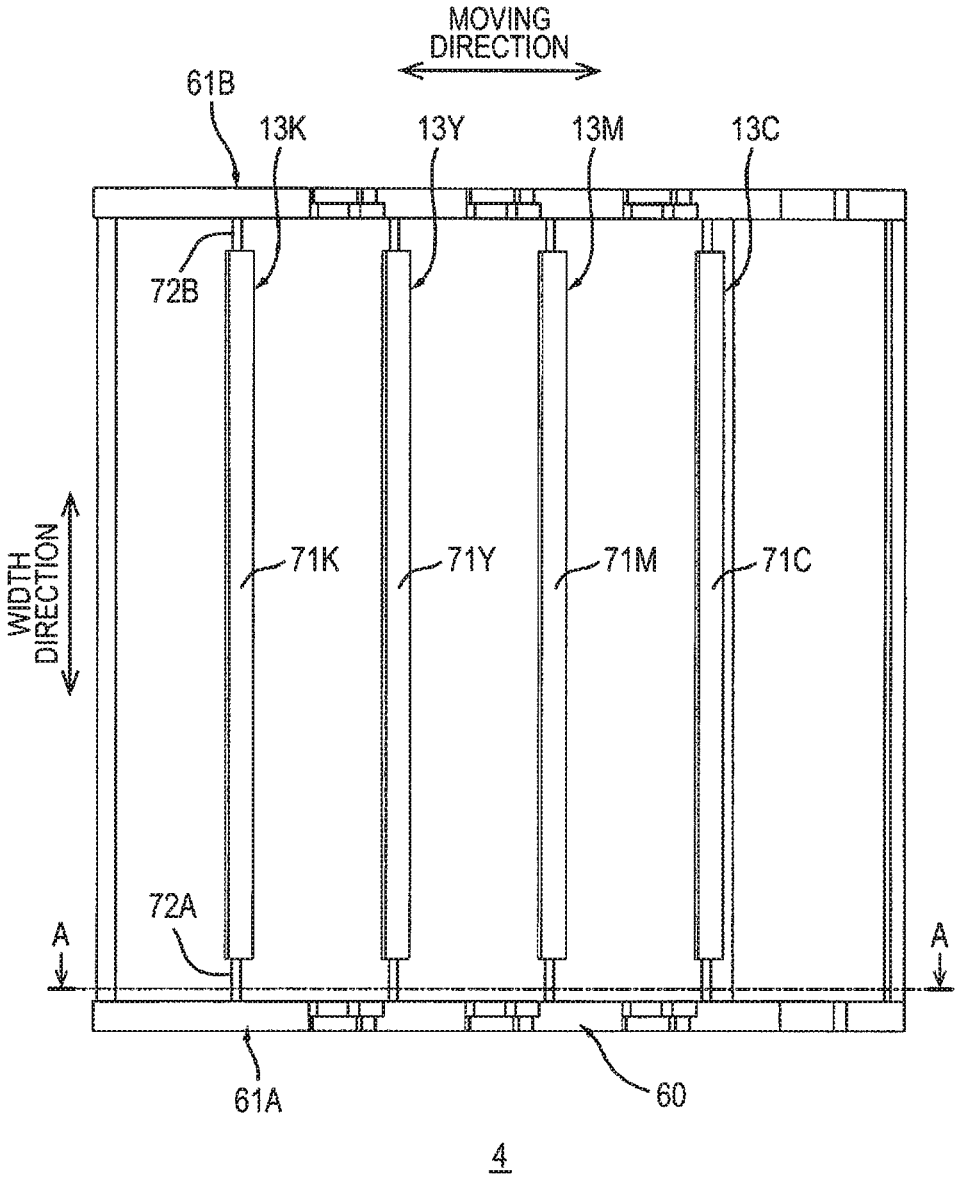
FIG. 5 is a plan view of the drawer unit illustrated in FIG. 1.
Figure 6:
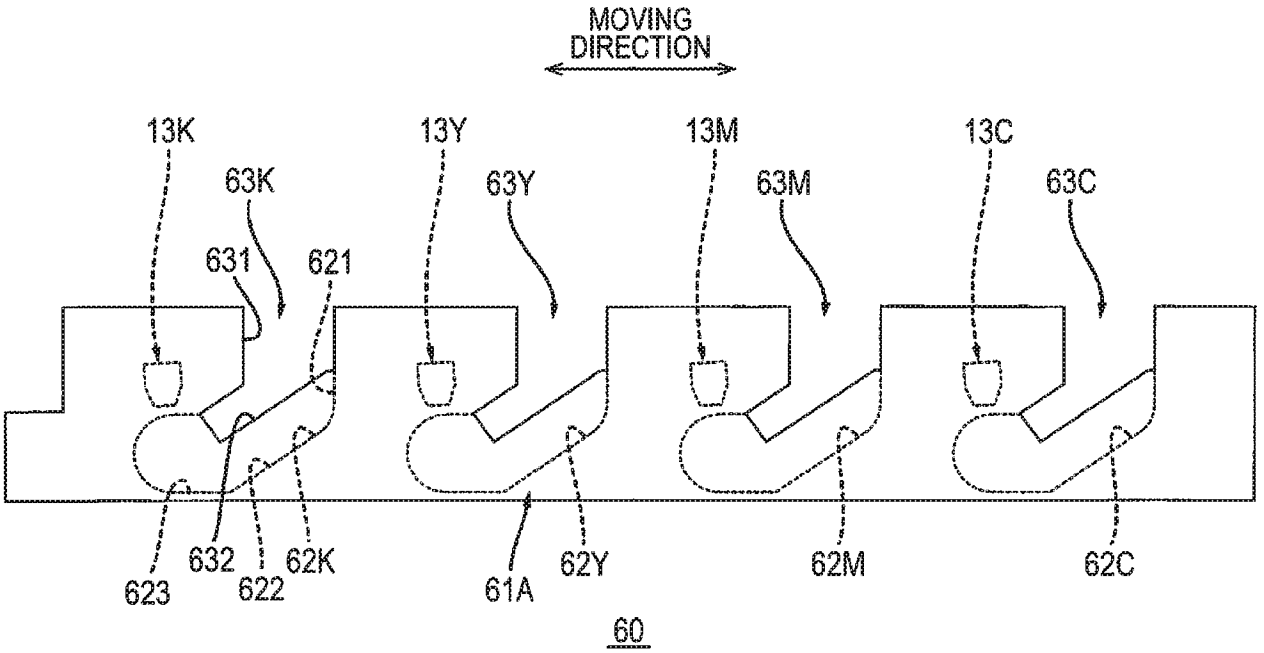
FIG. 6 is a side view of the drawer unit illustrated in FIG. 5.

As shown in FIG. 5, the drawer unit 4 includes the drawer frame 60 in addition to the above-described plurality of exposure heads 13K, 13Y, 13M, 13C.

The plurality of drum cartridges 5K, 5Y, 5M, 5C and the plurality of developing cartridges 6K, 6Y, 6M, 6C are configured to be mounted onto the drawer frame 60. The drawer frame 60 includes two side plates 61A, 61B. The plurality of exposure heads 13K, 13Y, 13M, 13C is located between the side plate 61A and the side plate 61B in the width direction. The width direction intersects the moving direction and the upper-lower direction. In a state where the drum cartridge 5K and the developing cartridge 6K are mounted on the drawer frame 60, the width direction is the same direction as the axial direction and as the direction in which the developing roller 17K extends. In a state where the plurality of drum cartridges 5K, 5Y, 5M, 5C and the plurality of developing cartridges 6K, 6Y, 6M, 6C are mounted on the drawer unit 4, the plurality of drum cartridges 5K, 5Y, 5M, 5C and the plurality of developing cartridges 6K, 6Y, 6M, 6C are located between the side plate 61A and the side plate 61B. The side plate 61A and the side plate 61B both extend in the moving direction. The side plate 61A and the side plate 61B both have a flat plate shape. As shown in FIG. 6, the side plate 61A includes a plurality of drum guides 62K, 62Y, 62M, 62C, and a plurality of developing guides 63K, 63Y, 63M, 63C. In other words, the drawer frame 60 includes the drum guide 62K and the developing guide 63K. Note that the side plate 61B has the same structure as the side plate 61A and is described in the same way as the side plate 61A. Therefore, a description of the side plate 61B is omitted.

3.1 Plurality of Drum Guides

The plurality of drum guides 62K, 62Y, 62M, 62C forms a row in the moving direction with intervals between the drum guides.

The drum guide 62K guides the drum cartridge 5K when the drum cartridge 5K is mounted. When the drum cartridge 5K is mounted onto the drawer unit 4, the drum guide 62K guides the cylindrical portion 37A (see FIG. 3) of the flange receiving member 32A of the drum cartridge 5K to a position at which the photosensitive drum 14K (see FIG. 1) is located below the exposure head 13K. When the drum cartridge 5K is mounted onto the drawer unit 4, the cylindrical portion 37A of the flange receiving member 32A of the drum cartridge 5K is fitted into the drum guide 62K. The drum guide 62K is a groove. The drum guide 62K is a recess. The drum guide 62K is recessed in a direction that separates from the side plate 61B (see FIG. 5) in the width direction.

The drum guide 62K includes a first portion 621, a second portion 622, and a third portion 623. The first portion 621 is located between the exposure head 13K and the exposure head 13Y in the moving direction. The first portion 621 extends in the upper-lower direction. The second portion 622 extends from a lower end of the first portion 621. The second portion 622 is inclined relative to the moving direction. More specifically, the second portion 622 inclines farther downward as the second portion 622 approaches the exposure head 13K in the moving direction. In other words, a distance between the second portion 622 and the exposure head 13K in the moving direction decreases downward. The third portion 623 extends from a lower end of the second portion 622. The third portion 623 is located below the exposure head 13K. The third portion 623 extends in the moving direction.

A drum guide 62Y guides the drum cartridge 5Y when the drum cartridge 5Y is mounted. The drum guide 62Y is located between the exposure head 13Y and the exposure head 13M in the moving direction. A drum guide 62M guides the drum cartridge 5M when the drum cartridge 5M is mounted. The drum guide 62M is located between the exposure head 13M and the exposure head 13C in the moving direction. A drum guide 62C guides the drum cartridge 5C when the drum cartridge 5C is mounted. The drum guide 62C is located at an opposite side from the exposure head 13M with respect to the exposure head 13C in the moving direction. The drum guides 62Y, 62M, 62C all have the same structure as the drum guide 62K and are described in the same way as the drum guide 62K. Therefore, a description of the drum guides 62Y, 62M, 62C is omitted.

3.2 Plurality of Developing Guides

The plurality of developing guides 63K, 63Y, 63M, 63C form a row in the moving direction with intervals between the developing guides.

The developing guide 63K guides the developing cartridge 6K when the developing cartridge 6K is mounted. The developing guide 63K is a cutout (recess). Note that the developing guide 63K may be a groove. The developing guide 63K is located at the same side as the drum guide 62K with respect to the exposure head 13K in the moving direction. With this configuration, the drum cartridge 5K can be mounted from the same side as the developing cartridge 6K with respect to the exposure head 13K in the moving direction.

The developing guide 63K includes a first portion 631 and a second portion 632. The first portion 631 is located between the exposure head 13K and the exposure head 13Y in the moving direction. The first portion 631 extends in the upper-lower direction. The first portion 631 is located at the same position as the first portion 621 of the drum guide 62K in the moving direction. That is, the first portion 631 overlaps the first portion 621 of the drum guide 62K in the axial direction. In other words, a part of the drum guide 62K overlaps a part of the developing guide 63K in the axial direction. The second portion 632 extends from a lower end of the first portion 631. The second portion 632 is inclined relative to the moving direction. More specifically, the second portion 632 is inclined downward as it is closer to the exposure head 13K in the moving direction. In other words, the distance between the second portion 632 and the exposure head 13K in the moving direction decreases downward. The second portion 632 overlaps the second portion 622 of the drum guide 62K in the axial direction.

Note that the developing guide 63Y guides the developing cartridge 6Y when the developing cartridge 6Y is mounted. The developing guide 63M guides the developing cartridge 6M when the developing cartridge 6M is mounted. The developing guide 63C guides the developing cartridge 6C when the developing cartridge 6C is mounted. The developing guides 63Y, 63M, 63C all have the same structure as the developing guides 63K and are described in the same way as the developing guide 63K. Therefore, a description of the developing guides 63Y, 63M, 63C is omitted.

3.3 Exposure Head

As shown in FIG. 5, the exposure head 13K is supported by the drawer frame 60. The exposure head 13K extends in the width direction of the drawer unit 4. The exposure head 13K includes an exposure frame 71K, an LED array, the boss 72A, and the boss 72B. The LED array is not shown in the drawings. Note that the LED array is positioned a particular distance from the photosensitive drum 14K in a state where the drum cartridge 5K is mounted on the drawer unit 4. The LED array includes a plurality of LEDs. The plurality of LEDs is arranged in the width direction of the drawer unit 4. In other words, the plurality of LED is arranged in the axial direction in a state where the drum cartridge 5K is mounted on the drawer unit 4.

The exposure frame 71K accommodates the LED array. The exposure frame 71K extends in the width direction of the drawer unit 4. The exposure frame 71K has a tubular shape. The exposure frame 71K is located between the side plate 61A and the side plate 61B in the width direction of the drawer unit 4. The exposure frame 71K is located with an interval from the side plate 61A in the width direction of the drawer unit 4. The exposure frame 71K is located with an interval from the side plate 61B in the width direction of the drawer unit 4.

The boss 72A is located between the exposure frame 71K and the side plate 61A in the width direction of the drawer unit 4. The boss 72A extends from the exposure frame 71K. The boss 72A extends in the width direction of the drawer unit 4. In other words, the boss 72A extends in the axial direction in a state where the drum cartridge 5K is mounted on the drawer unit 4. The boss 72A has a circular cylindrical shape. By forming the boss 72A in a circular cylindrical shape, the boss 72A stably contacts the contact surface S1 of the flange receiving member 32A. Because of this, excessive precision is not required when forming the boss 72A, and hence the boss 72A can be easily formed. The boss 72A is fitted into an elongated hole 73 (see FIG. 7) of the side plate 61A. The elongated hole 73 extends in the upper-lower direction.

The boss 72B is located between the exposure frame 71K and the side plate 61B in the width direction of the drawer unit 4. The boss 72B has the same shape as the boss 72A. The boss 72B is fitted into an elongated hole of the side plate 61B. The elongated hole of the side plate 61B is not shown in the drawings. The elongated hole of the side plate 61B has the same shape as the elongated hole 73.

The exposure head 13K is supported by the drawer unit 4 by fitting the boss 72A into the elongated hole 73 of the side plate 61A and fitting the boss 72B into the elongated hole of the side plate 61B. The exposure head 13K is configured to move in the upper-lower direction relative to the drawer unit 4 through the boss 72A being guided by the elongated hole 73 of the side plate 61A and the boss 72B being guided by the elongated hole of the side plate 61B. Note that the exposure head 13K moves relative to the drawer unit 4 in order to adjust the position of the exposure head 13K relative to the photosensitive drum 14K when the drum cartridge 5K is mounted onto the drawer unit 4.

The exposure heads 13Y, 13M, 13C all have the same structure as the exposure head 13K and are described in the same way as the exposure head 13K. Therefore, a description of the exposure heads 13Y, 13M, 13C is omitted.

3.4 Pressing Member and Spring

Figure 7:
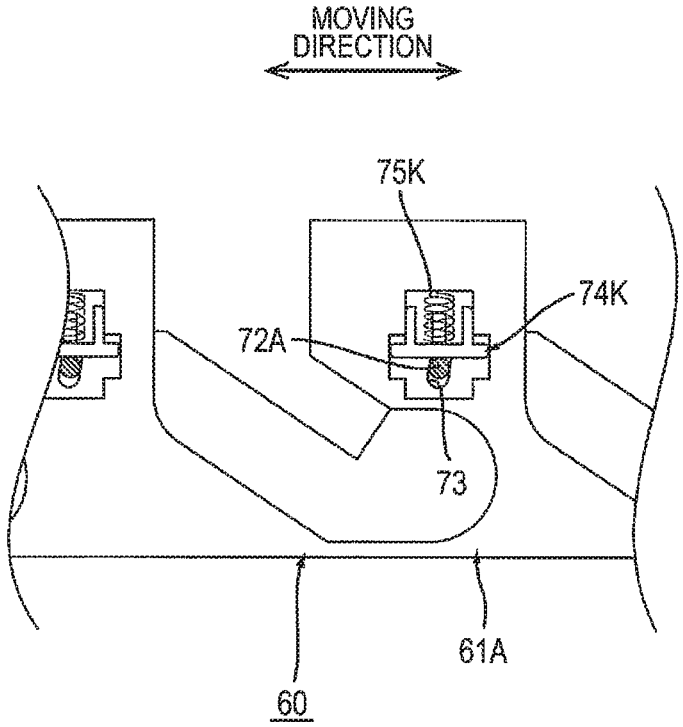
FIG. 7 is a cross-sectional view of the drawer unit illustrated in FIG. 5 taken along the line A-A.

As shown in FIG. 7, the drawer frame 60 includes a pressing member 74K and a spring 75K.

The pressing member 74K presses the exposure head 13K so that the boss 72A contacts the contact surface S1 (see FIG. 8) in a state where the drum cartridge 5K is mounted on the drawer frame 60. More specifically, the pressing member 74K presses the boss 72A downward by being pressed downward by the spring 75K. The pressing member 74K is located above the boss 72A. The pressing member 74K contacts the boss 72A. The pressing member 74K extends in the moving direction. The pressing member 74K has a plate-like shape. The pressing member 74K is attached to the side plate 61A. The pressing member 74K is configured to move in the upper-lower direction relative to the side plate 61A. By providing the drawer frame 60 with the pressing member 74K, the boss 72A is positioned on the contact surface S1.

The spring 75K presses the pressing member 74K toward the boss 72A. The spring 75K is attached to the side plate 61A. The spring 75K is located at an opposite side from the boss 72A with respect to the pressing member 74K. The spring 75K contacts the pressing member 74K.

Note that the drawer unit 4 further includes a pressing member and a spring for pressing the exposure head 13Y, a pressing member and a spring for pressing the exposure head 13M and a pressing member and a spring for pressing the exposure head 13C. All of these pressing members have the same structure as the pressing member 74K and are described in the same way as the pressing member 74K. Further, all of the springs have the same structure as the spring 75K and are described in the same way as the spring 75K. Therefore, descriptions of the pressing members and the springs are omitted.

4. Removing Drum Cartridge from Drawer Unit

The operation of removing the drum cartridge from the drawer unit is described below with reference to FIGS. 8 to 11.

First, as shown in FIG. 8, a user pulls the developing cartridge 6K out from the drawer unit 4 when the drawer frame 60 is at the external position.

Then, the developing cartridge 6K is guided by the developing guide 63K to pass between the exposure head 13K and the exposure head 13Y and be removed from the drawer unit 4.

Figure 9:
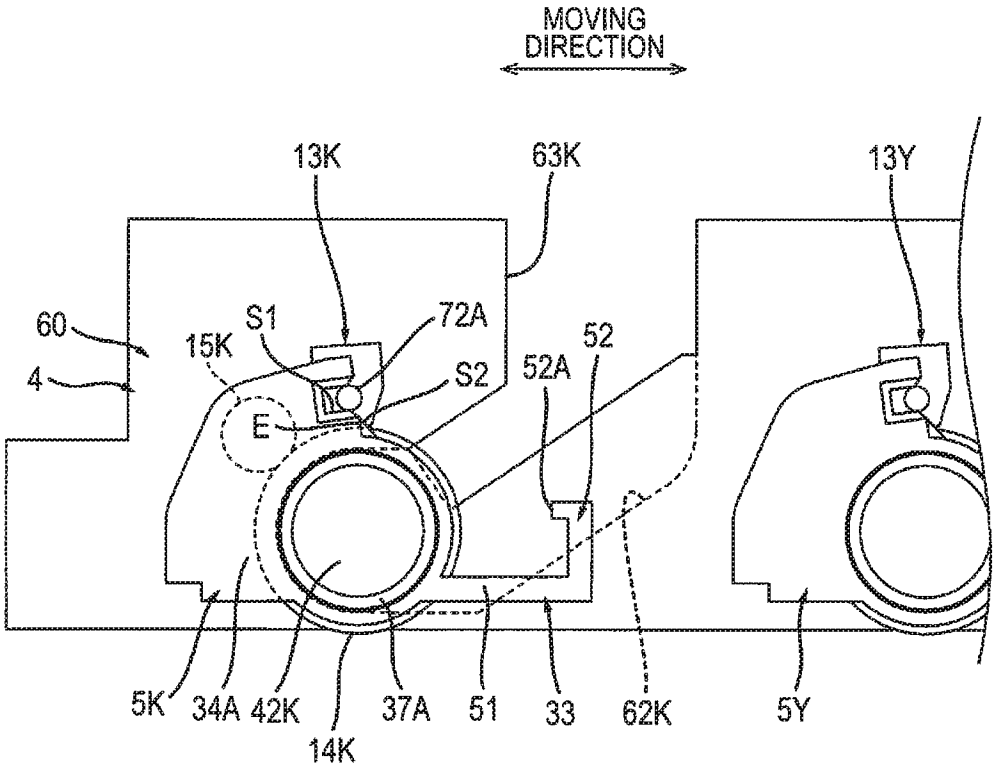
FIG. 9 is an explanatory view continuing on from FIG. 8 for explaining removal of the drum cartridge from the drawer unit and illustrates a state in which the developing cartridge has been removed from the drawer unit, in which the drum cartridge is at a first position.
Figure 10:
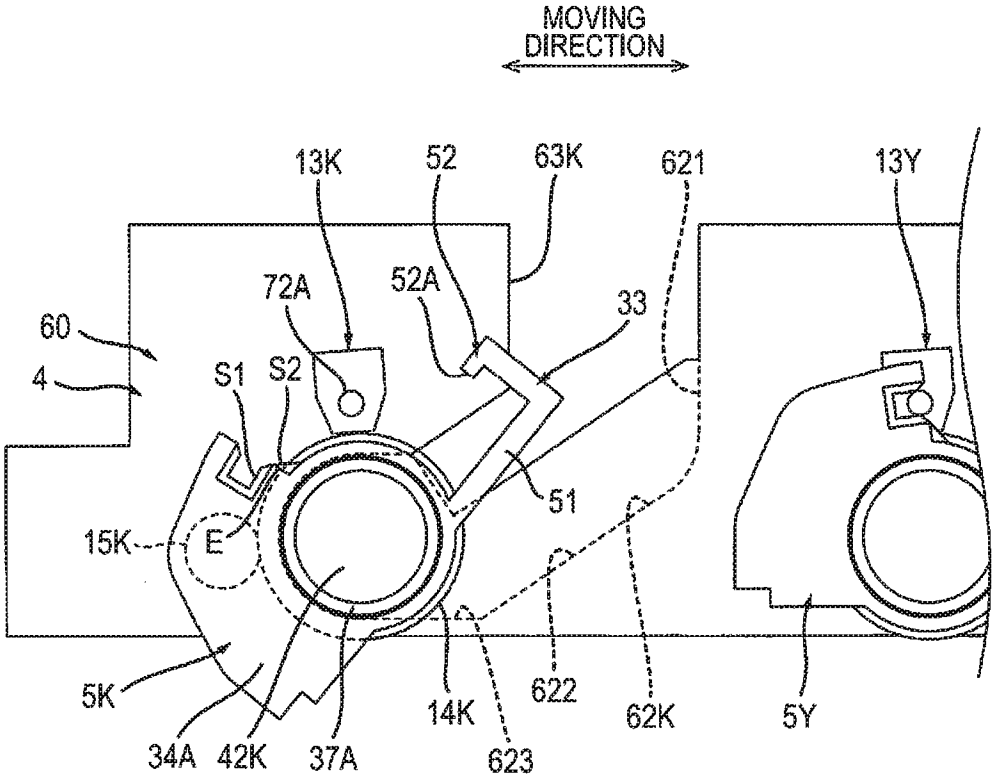
FIG. 10 is an explanatory view continuing on from FIG. 9 for explaining removal of the drum cartridge from the drawer unit and illustrates a state in which the drum cartridge is at a second position.

Next, as shown in FIGS. 9 and 10, the user rotatably moves the drum cartridge 5K about the cylindrical portion 37A of the flange receiving member 32A such that the contact surface S1 separates from the boss 72A. Note that the position of the drum cartridge 5K (see FIG. 9) when the contact surface S1 contacts the boss 72A is the first position. When the drum cartridge 5K is at the first position, the exposure head 13K is positioned (located at a particular position) relative to the photosensitive drum 14K and the drum cartridge 5K is not allowed to be removed from the drawer frame 60. When the drum cartridge 5K is at the first position, the charger 15K is located at an opposite side from the first portion 621 of the drum guide 62K with respect to the exposure head 13K in the moving direction. Further, the position of the drum cartridge 5K (see FIG. 10) when the contact surface S1 is separated from the boss 72A is the second position. When the drum cartridge 5K is at the second position, the positioning of the exposure head 13K relative to the photosensitive drum 14K is released (that is, the exposure head 13K is deviated from the particular position relative to the photosensitive drum 14K) and the drum cartridge 5K is allowed to be removed from the drawer frame 60. In other words, the drum cartridge 5K is configured to rotatably move between the first position (see FIG. 9) and the second position (see FIG. 10) in a state where the drum cartridge 5K is mounted on the drawer frame 60 and where the drawer frame 60 is at the external position. Note that the direction of rotation of the drum cartridge 5K at this time is a direction opposite from the direction of rotation of the photosensitive drum 14K. When the drum cartridge 5K is at the second position, the charger 15K is located at a position lower than the exposure head 13K. When the drum cartridge 5K is at the second position, the first side wall 34A of the drum cartridge 5K is located at a position lower than the boss 72A of the exposure head 13K.

Figure 11:
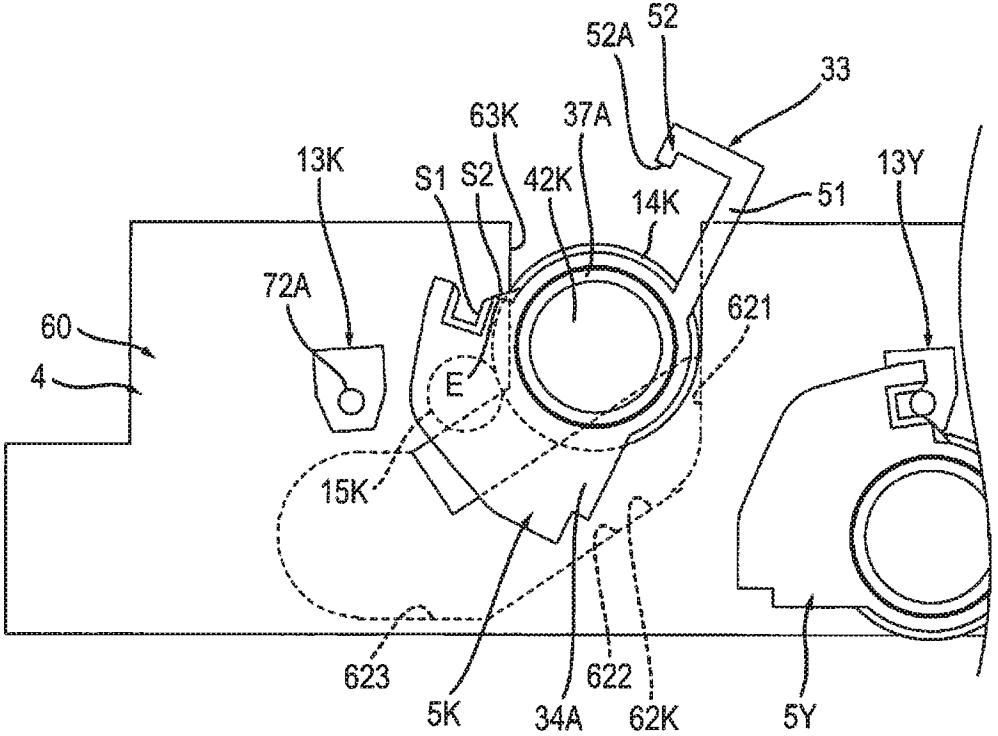
FIG. 11 is an explanatory view continuing on from FIG. 10 for explaining removal of the drum cartridge from the drawer unit and illustrates a state in which the drum cartridge is removed.

Next, as shown in FIG. 11, the user pulls out, from the drawer unit 4, the drum cartridge 5K that can now be removed from the drawer frame 60.

Then, the drum cartridge 5K moves in the moving direction by being guided by the third portion 623 of the drum guide 62K. At this time, the charger 15K passes below the exposure head 13K. The first side wall 34A of the drum cartridge 5K passes below the boss 72A of the exposure head 13K.

After that, the drum cartridge 5K is guided by the second portion 622 and the first portion 621 of the drum guide 62K to pass between the exposure head 13K and the exposure head 13Y and be removed from the drawer unit 4.

5. Mounting Drum Cartridge onto Drawer Unit

Mounting of the drum cartridge onto the drawer unit is described below with reference to FIGS. 8 to 11.

First, when the drawer frame 60 is at the external position as shown in FIG. 11, the user moves the drum cartridge 5K to be guided by the second portion 622 and the third portion 623 of the drum guide 62K, and to pass between the exposure head 13K and the exposure head 13Y, thereby mounting the drum cartridge 5K on the drawer unit 4 as shown in FIG. 10. At this time, the charger 15K passes below the exposure head 13K. In addition, the first side wall 34A of the drum cartridge 5K passes below the boss 72A of the exposure head 13K.

Next, as shown in FIG. 9, the user rotates the drum cartridge 5K about the cylindrical portion 37A of the flange receiving member 32A from the second position (see FIG. 10) to the first position (see FIG. 9) such that the boss 72A contacts the contact surface S1. When the drum cartridge 5K moves from the second position to the first position, the boss 72A contacts the guide surface S2 and the guide surface S2 guides the boss 72A to the contact surface S1. When the guide surface S2 guides the boss 72A, the boss 72A does not contact the first side wall 34A. This is because the guide surface S2 is located farther downstream than the edge E of the first side wall 34A in the direction of rotational movement of the drum cartridge 5K when the drum cartridge 5K is mounted onto the drawer unit 4.

Then, as shown in FIG. 8, the user mounts the developing cartridge 6K onto the drawer frame 60.

6. Operations and Effects

With the image forming apparatus 1, as shown in FIGS. 9 and 10, by rotatably moving the drum cartridge 5K from the first position (see FIG. 9) to the second position (see FIG. 10), the positioning of the exposure head 13K relative to the photosensitive drum 14K is released and the drum cartridge 5K is removed from the drawer frame 60.

With this configuration, after the drum cartridge 5K is located at the second position, the drum cartridge 5K can be removed so as to avoid the exposure head 13K.

When the drum cartridge 5K is mounted onto the drawer frame 60, by mounting the drum cartridge 5K onto the drawer frame 60 so as to avoid the exposure head 13K and rotating the drum cartridge 5K to the first position after the drum cartridge 5K is at the second position, the drum cartridge 5K can be mounted while avoiding the exposure head 13K.

As a result, the drum cartridge 5K can be mounted onto or removed from the drawer unit 4 that includes the exposure head 13K while avoiding the exposure head 13K.

7. Modification

While the disclosure has been described in detail with reference to the above aspects thereof, it would be apparent to those skilled in the art that various changes and modifications may be made therein without departing from the scope of the claims.

For example, the pressing member 74K and the spring 75K may be provided at the drum cartridge 5K.

The pressing member 74K may be, for example, a spring such as a torsion spring. In this case, the drawer unit 4 does not include the spring 75K for pressing the pressing member 74K.

What is claimed is:

1. An image forming apparatus comprising:

a main housing;

a drum cartridge including a photosensitive drum;

a developing cartridge configured to accommodate developer to be supplied to the photosensitive drum; and a drawer unit configured such that the drum cartridge and the developing cartridge are mounted thereon, the drawer unit being configured to move in a moving direction between an internal position at which the drawer unit is located inside the main housing and an external position at which the drawer unit is located outside the main housing, the drawer unit including:

a drawer frame configured such that the drum cartridge and the developing cartridge are mounted thereon; and an exposure head configured to expose the photosensitive drum, in a state where the drawer frame is located at the external position and where the drum cartridge is mounted on the drawer frame, the drum cartridge being configured to rotatably move between:

a first position at which the exposure head is located at a particular position relative to the photosensitive drum and the drum cartridge is prevented from being removed from the drawer frame; and a second position at which the exposure head is deviated from the particular position relative to the photosensitive drum and the drum cartridge is allowed to be removed from the drawer frame.

2. The image forming apparatus according to claim 1, wherein the drum cartridge includes a charger configured to charge a surface of the photosensitive drum; and wherein a width of the charger is larger than or equal to one third (⅓) of a diameter of the photosensitive drum and smaller than or equal to a half (½) of the diameter of the photosensitive drum.

3. The image forming apparatus according to claim 1, wherein the drum cartridge includes a handle;

wherein the exposure head includes a boss extending in an axial direction in which a rotational axis of the photosensitive drum extends;

wherein the drum cartridge has a contact surface configured to contact the boss in a state where the drum cartridge is mounted on the drawer unit; and wherein an angle formed by a first imaginary plane and a second imaginary plane is larger than or equal to 90 degrees and smaller than 160 degrees, the first imaginary plane passing through the rotational axis of the photosensitive drum and intersecting the handle, the second imaginary plane passing through the rotational axis of the photosensitive drum and intersecting the contact surface.

4. The image forming apparatus according to claim 3, wherein the handle is located below the developing cartridge in a state where the drum cartridge and the developing cartridge are mounted on the drawer frame and where the drum cartridge is located at the first position.

5. The image forming apparatus according to claim 3, wherein the photosensitive drum has a flange at an end portion thereof;

wherein the drum cartridge includes a flange receiving member configured to receive the flange; and wherein the flange receiving member has the contact surface at a different position from a portion that receives the flange.

6. The image forming apparatus according to claim 5, wherein the drum cartridge includes a first side wall, a second side wall, and a charger configured to charge a surface of the photosensitive drum;

wherein the exposure head includes a boss;

wherein the flange receiving member has a guide surface located between the first side wall and the second side wall in the axial direction, the guide surface being configured to guide the boss to the contact surface without allowing the boss to contact the first side wall and the second side wall; and wherein the guide surface is located at an opposite side from the charger with respect to the contact surface in the moving direction.

7. The image forming apparatus according to claim 6, wherein the boss has a circular cylindrical shape.

8. The image forming apparatus according to claim 6, wherein the drawer frame includes a pressing member configured to press the exposure head such that the boss contacts the contact surface in a state where the drum cartridge is mounted on the drawer frame.

9. The image forming apparatus according to claim 3, further comprising a second drum cartridge including a second photosensitive drum and configured to be mounted on the drawer frame, the second drum cartridge being arranged with the drum cartridge with an interval therebetween in the moving direction in a state where the drum cartridge and the second drum cartridge are mounted on the drawer frame; and wherein the handle is located between the drum cartridge and the second drum cartridge in a state where the drum cartridge and the second drum cartridge are mounted on the drawer frame and where the drum cartridge is located at the first position.

10. The image forming apparatus according to claim 1, wherein the drawer frame includes:

a drum guide configured to guide mounting of the drum cartridge; and a developing guide configured to guide mounting of the developing cartridge; and wherein a part of the drum guide overlaps a part of the developing guide in an axial direction in which a rotational axis of the photosensitive drum extends.

11. The image forming apparatus according to claim 5, wherein the drum cartridge includes a side wall located at an end of the drum cartridge in the axial direction;

wherein the exposure head includes a boss extending in the axial direction; and wherein the flange receiving member has a guide surface continuous with the contact surface, the guide surface being located at a downstream side of the contact surface in a direction of rotational movement of the drum cartridge when the drum cartridge is mounted onto the drawer unit, the guide surface being located at a downstream side of an edge of the side wall in the direction of rotational movement of the drum cartridge when the drum cartridge is mounted onto the drawer unit, the guide surface being configured to guide the boss to the contact surface without allowing the boss to contact the edge of the side wall in accordance with the rotational movement of the drum cartridge when the drum cartridge is mounted onto the drawer unit.

* * * * *